US005826134A

United States Patent [19]

Hino et al.

[11] Patent Number: 5,826,134

[45] Date of Patent: Oct. 20, 1998

[54] ELECTROPHOTOGRAPHING APPARATUS HAVING A TONER EMPTY DISCRIMINATING UNIT

[75] Inventors: Toshio Hino; Yoshihiro Tonomoto, both of Kawasaki, Japan

[73] Assignee: Fujitsu Limited, Kawasaki, Japan

[21] Appl. No.: 887,282

[22] Filed: Jul. 2, 1997

[30] Foreign Application Priority Data

Jan. 23, 1997 [JP] Japan ..... 9-009891

[51] Int. Cl.[6] ..... G03G 15/08

[52] U.S. Cl. ..... 399/27; 399/24; 399/62

[58] Field of Search ..... 399/27, 29, 30, 399/58, 59, 62, 258, 260, 24; 222/DIG. 1

[56] References Cited

U.S. PATENT DOCUMENTS

| | | | |
|---|---|---|---|
| 4,632,534 | 12/1986 | Shimono | 399/27 |
| 4,951,091 | 8/1990 | Nawata | 399/27 |
| 4,977,429 | 12/1990 | Tani et al. | 399/27 |
| 5,036,363 | 7/1991 | Ida et al. | 399/30 |
| 5,138,386 | 8/1992 | Okano et al. | 399/62 |

FOREIGN PATENT DOCUMENTS 07-209981 8/1995 Japan .

*Primary Examiner*—Arthur T. Grimley
*Assistant Examiner*—Sophia S. Chen
*Attorney, Agent, or Firm*—Armstrong, Westerman, Hattori, McLeland & Naughton

[57] ABSTRACT

A toner near empty discriminating unit discriminates a near empty indicating that the toner approaches an empty state on the basis of a detection value of a toner sensor. When the toner near empty is determined, a toner supply amount calculating unit calculates a toner supply amount (w) per time as w=W/X from the number (X) of toner supplying times of a toner supply counter and a specified toner filling amount (W) when a toner cartridge is set. On the basis of the calculated toner supply amount (w) of one time, a correction processing unit corrects a rotational speed of a supply roller of a toner supply control unit and an operation time of the supply roller, or the number of discriminating times of the toner empty and the number of discriminating times of a replacement of an expendable item.

14 Claims, 14 Drawing Sheets

FIG. 8

| ITEM | CONSTANT |
|---|---|
| TONER CARTRIDGE FILLING AMOUNT W | 600g |
| TONER SUPPLY AMOUNT w0 OF ONE TIME | 0. 5g/TIME |
| TONER SUPPLY OPERATION TIME T | 600ms |
| TONER SUPPLY ROTATIONAL SPEED R | 6rpm |
| THE NUMBER OF DISCRIMINATING TIMES N1 OF TONER EMPTY | 1200 TIMES |
| THE NUMBER OF DISCRIMINATING TIMES N2 OF EXPENDABLE ITEM LIFE | 6000 TIMES |

ELECTROPHOTOGRAPHING APPARATUS HAVING A TONER EMPTY DISCRIMINATING UNIT

BACKGROUND OF THE INVENTION

The invention relates to an electrophotographying apparatus which is used in a printer, a copying apparatus, a facsimile apparatus, or the like such that after an electrostatic latent image formed onto a photosensitive drum was developed by a two-component developing agent composed of toner and carrier, the developed image is transferred onto a paper. More particularly, the invention relates to an electrophotographying apparatus in which a toner supply amount is obtained on the basis of the number of supplying times of the toner from a toner hopper provided for a developing unit, thereby discriminating a toner near empty, a toner empty, a replacement of an expendable item, and the like.

Hitherto, in an electrophotographying apparatus which is used in a printer, a copying apparatus, a facsimile apparatus, or the like, an electrostatic latent image is formed onto a photosensitive drum by a scan of a light beam, a toner image is developed by a developing unit by using a two-component developing agent composed of toner and carrier, and the developed toner image is transferred and fixed onto a paper which is conveyed, thereby obtaining a clear print image. A toner hopper filled with toner is attached to the developing unit. When the toner in the developing unit is consumed by the development, a toner supply roller provided for the toner hopper is driven, thereby supplying a predetermined amount of toner. The toner contained in the toner hopper is monitored, a toner near empty slightly before the toner becomes empty or a toner empty when the toner is empty is detected, and such a state is displayed to the user, thereby promoting the user to fill the toner by setting a toner cartridge. In the detection of the near empty or empty of the toner in the electrophotographying apparatus as mentioned above, since a toner supply amount of one time is determined by a rotational speed of a toner supply roller and a supply rotation time, the number of supplying times of the toner is counted, and when it reaches a specified number of times to discriminate a predetermined near empty or empty, the near empty or empty is displayed, thereby requesting the user to exchange the toner cartridge.

In the conventional discrimination of the near empty or empty of the toner based on the number of toner supplying times as mentioned above, however, since a variation of the toner supply amount of one time is large, there is a problem such that the toner state cannot be correctly discriminated. That is, a fluidity of the toner largely fluctuates due to an influence by an environmental humidity of the apparatus and a variation of the toner supply amount of one time which is supplied from the toner hopper is large. Therefore, when the near empty or empty of the toner is detected by the predetermined number of supplying times of the toner, a difference between the detected toner amount and an actual remaining toner amount increases and a detecting precision deteriorates. Therefore, in the case where a large quantity of toner remains in the toner hopper because the toner empty is detected too early, when the toner cartridge is set and the toner is filled, there is possibility such that the toner overflows and makes the inside of the apparatus dirty. Particularly, when a paper conveying path is made dirty by the toner, a stain of the print occurs. Moreover, in case of getting extremely dirty, there is a case where not only the inside of the apparatus but also the floor or the user becomes dirty. When the detection of the toner empty is delayed, the toner is insufficient and a print density decreases during the use of the apparatus. Further, since the carrier is agitated in a state in which the toner density of the two-component developing agent in the developing unit decreases, a stress is given to the carrier and there is a problem such that a life of the developing agent is shortened or the like. Further, in the electrophotographying apparatus, with respect to expendable items such as desmoke filter of an apparatus using a cleaning blade, a cleaning brush, and a flash fixing unit, a toner collection filter of an apparatus using a cleaning blower, and the like in which lives are largely concerned with a toner consumption amount, a replacement timing is determined on the basis of the number of supplying times of the toner. In this case, in consideration of a variation of the toner supply amount, the number of supplying times of the toner until the replacement is set to be slightly small. Therefore, there are problems such that the replacement period of the expendable item is shorter than it is necessary, a load of the replacing work by the operator increases, and the running costs rise.

In order to decrease the variation by the counting of the number of supplying times of the toner, on the other hand, a construction in which a toner sensor is attached to the toner hopper and the toner near empty and toner empty are detected is also considered. However, even when the toner sensor is attached, there is a variation in a sensor detection signal. A sensor discrimination value for detecting early the toner near empty or toner empty is set in order to prevent the variation. Therefore, the near empty or empty is detected early by the toner sensor and there is a fear such that the toner overflows at the time of the setting of the toner cartridge and makes the inside of the apparatus dirty. There is a case where the toner sensor erroneously detects the toner near empty or toner empty due to a noise, a failure of the sensor, or the like. There is also a problem such that a detecting stability lacks as compared with the case of the counting of the number of supplying times of the toner.

SUMMARY OF THE INVENTION

According to the invention, there is provided an electrophotographying apparatus which can correctly discriminate a near empty or empty of a toner and, further, a replacement timing of an expendable item by calculating an actual toner supply amount on the basis of a count value of the number of supplying times of the toner.

According to the invention, there is provided an electrophotographying apparatus in which an electrostatic latent image formed on a photosensitive drum (photosensitive material) is developed and, thereafter, is transferred onto a paper, comprising: a developing unit for developing the electrostatic latent image on the photosensitive drum by a two-component developing agent composed of toner and carrier; a toner density sensor for detecting a toner density of the 2-component developing agent in the developing unit; a toner hopper containing the toner to be supplied to the developing unit by receiving a filling of a specified amount (W) of toner by the setting of a toner cartridge; and a toner supplying mechanism for supplying the toner from the toner hopper to the developing unit by the driving of a toner supply roller. The control unit comprises: a toner supply control unit for supplying a specified amount w0 of toner from the toner hopper to the developing unit by driving a toner supply roller; each time the detection density of the toner density sensor is equal to or less than a specified value, a toner sensor for detecting the toner contained in the toner hopper; a toner near empty discriminating unit for discriminating a toner near empty indicating that the toner approaches an empty state on the basis of a detection value of the toner sensor; a toner supply counter which is reset when the toner is filled by the setting of a toner cartridge and counts the number (X) of toner supplying times by the toner supply control unit; and a toner empty discriminating unit for discriminating a toner empty state on the basis of the count value (X) of the toner supply counter.

The invention is characterized in that there is provided a toner supply amount calculating unit for calculating a toner supply amount (w) per time as w=W/X from the number (X) of toner supplying times of the toner supply counter and a specified toner filling amount (W) when the toner cartridge is set in the case where a toner near empty state is discriminated by the toner near empty discriminating unit and that the actual toner supply amount per time can be recognized by the apparatus itself. Further, a correction processing unit is provided. The correction processing unit can correct control parameters of the toner supply control unit on the basis of the toner supply amount (w) of one time calculated by the toner supply amount calculating unit so as to keep a predetermined specified toner supply amount w0 of one time. For example, when a rotational speed (R) and a supply operation time (T) of the toner supply roller of a toner supplying mechanism to determine the toner supply amount of one time have been preset as control parameters of the toner supply amount control unit, the correction processing unit obtains a ratio (w0/w) between the specified toner supply amount w0 and the toner supply amount (w) calculated by the toner supply amount calculating unit as a correction coefficient (K), thereby correcting to a correction rotational speed (K·R) in which the roller rotational speed (R) is multiplied by the correction coefficient (K). Therefore, the toner supply amount per time for a period of time from a timing when the toner is filled by the setting of the cartridge to a timing when a next toner near empty state is detected can be adjusted so as to be the specified toner supply amount w0. The discrimination about the toner empty based on the number of toner supplying times can be more accurately performed.

The correction processing unit corrects to a correction operation time (T·R) by multiplying a supply operation time (T) of the toner supply roller by the correction coefficient (K) obtained as a ratio (w0/w) between the specified toner supply amount w0 and the calculated toner supply amount (w). In this case as well, a toner supply amount per time for a period of time from a timing when the toner is filled by the setting of the cartridge to a timing when a next toner near empty state is detected can be adjusted so as to be equal to the specified toner supply amount w0. The discrimination about the toner empty based on the count value of the number of toner supplying times can be more accurately performed. Further, toner empty discriminating unit discriminates the toner empty state in which the number (X) of toner supplying times counted by the toner supply counter reaches a predetermined number N1 of discriminating times of the toner empty. In this case, the correction processing unit obtains the ratio (w0/w) between the specified toner supply amount w0 and the toner supply amount (w) calculated by the toner supply amount calculating unit as a correction coefficient (K), thereby correcting to a correction number of discriminating times (K·N1) obtained by multiplying the number N1 of toner empty discriminating times by the correction coefficient (K). Therefore, the number of toner empty discriminating times is corrected to the number of discriminating times according to a change in actual toner supply amount (w) without needing to correct the rotational speed (R) or supply operation time (T) of the toner supply roller so as to set the toner supply amount per time to the specified toner supply amount w0. The toner empty state can be more accurately detected. As a method of correcting the number of toner empty discriminating times by the correction processing unit, it is corrected to a value (A·K·N1) in which the correction value (K·N1) is further multiplied by a specified delay coefficient (A) (A>1) to delay the discrimination about the toner empty. Thus, the toner empty is detected early, thereby certainly preventing that the toner overflows due to the filling of the toner by the setting of the toner cartridge. The control unit further comprises: a life counter of an expendable item which is reset at the time of replacement of the expendable item and counts the number (Y) of toner supplying times by the toner supply control unit; and an expendable item replacement discriminating unit for discriminating a replacement of the expendable item when the number (Y) of toner supplying times counted by the life counter reaches a predetermined number N2 of discriminating times about the replacement of the expendable item. In this case, the correction processing unit obtains the ratio (w0/w) between the specified toner supply amount w0 and the toner supply amount (w) calculated by the toner supply amount calculating unit as a correction coefficient (K), thereby correcting to a correction number of discriminating times (K·N2) obtained by multiplying the number N2 of replacement discriminating times by the correction coefficient (K). Therefore, the number of discriminating times about the replacement of the expendable item is corrected to the value according to the actual change in toner supply amount (w) without needing to correct the rotational speed (R) or supply operation time (T) of the toner supply roller so as to set the toner supply amount per time to the specified toner supply amount w0. A timing to replace the expendable item can be more accurately discriminated. The expendable item replacement discriminating unit discriminates timings to replace, for example, a cleaning blade, a cleaning brush, a desmoke filter of a flash fixing unit, a toner collecting filter of a cleaning blower, and the like.

Another embodiment of the invention is characterized in that only a toner empty discriminating unit for discriminating a toner empty state of a toner hopper on the basis of a detection signal of a toner sensor without performing a discrimination about a toner near empty state based on a detection value of the toner sensor is provided and that, when the toner empty is discriminated, a toner supply amount (w) per time is calculated by a toner supply amount calculating unit from the number (X) of toner supplying times of a toner supply counter and a predetermined toner filling amount w0 of the toner cartridge. That is, the actual toner supply amount (w) per time is calculated from the specified toner filling amount (W) by the setting of the toner cartridge and the number (X) of toner supplying times until the discrimination of the toner empty sate based on the toner sensor and is recognized by the apparatus. In this case, the correction of the rotational speed (R) or supply operation time (T) of the toner supply roller in the toner supply control or the correction of the number N2 of discriminating times about the replacement of the expendable item is substantially the same as that in the fundamental embodiment.

The above and other objects, features, and advantages of the present invention will become more apparent from the following detailed description with reference to the drawings.

BRIEF DESCRIPTION OF THE DRAWINGS

FIG. 8 is an explanatory diagram of storage contents in a constant storing unit in FIG. 7;

DETAILED DESCRIPTION OF THE PREFERRED EMBODIMENTS

[Construction and functions of apparatus]

Figure 1:
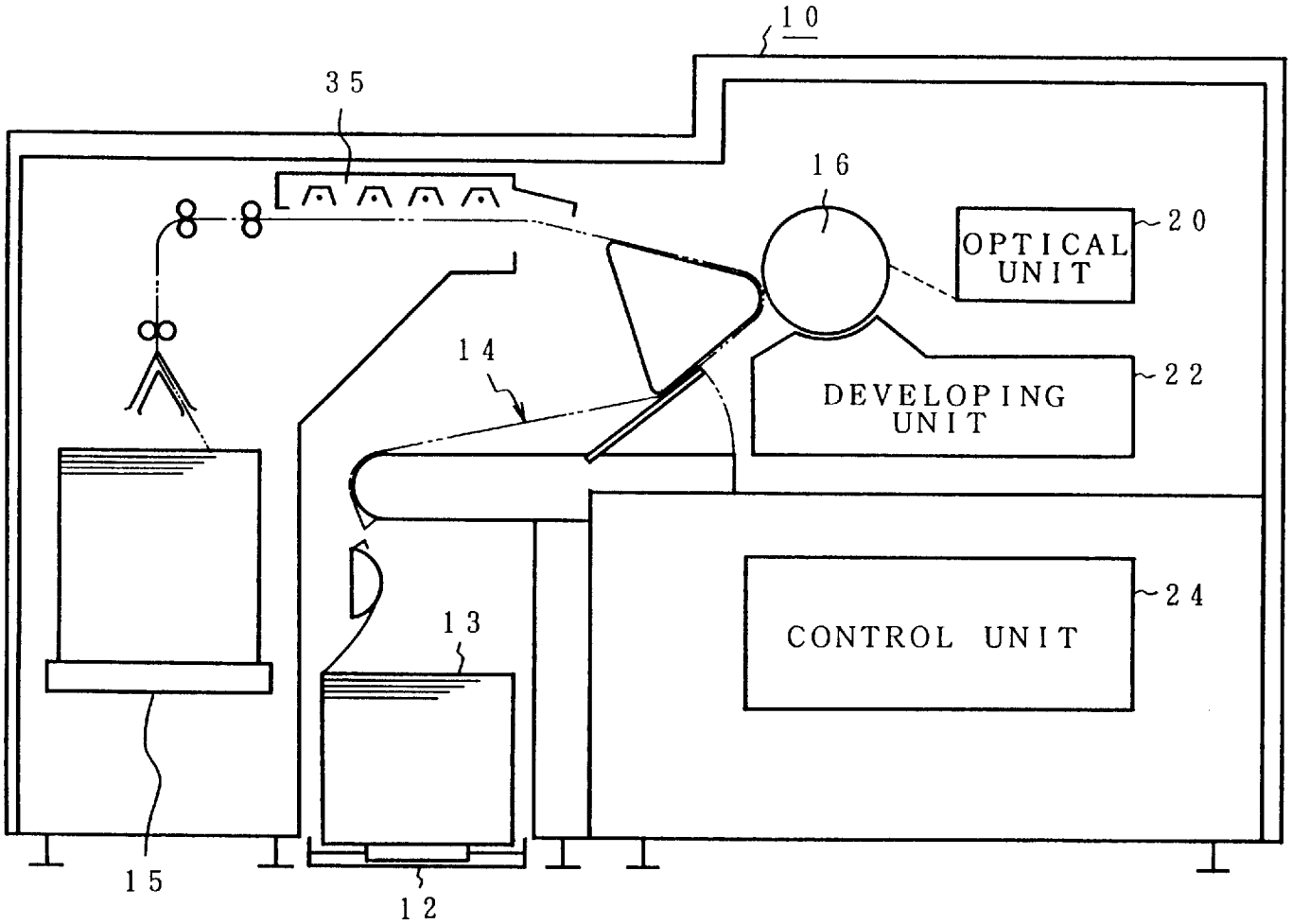
FIG. 1 is a schematic constructional diagram of a page printer to which the invention is applied.

FIG. 1 shows an embodiment of an electrophotographing apparatus to which the invention is applied and relates to a page printer as an example. According to a page printer 10, a continuous paper 13 is enclosed in a hopper 12. The continuous paper pulled out from the hopper 12 passes through a paper conveying path 14 and is sent to a stacker 15. A photosensitive drum unit 16 is provided in the middle of the paper conveying path 14. An optical unit 20 and a developing unit 22 are provided for the photosensitive drum unit 16. Further, a control unit 24 is provided, thereby performing a print control of the page printer 10. The photosensitive drum unit 16, optical unit 20, and developing unit 22 construct a main portion of the electrophotographying apparatus according to the invention. The photosensitive drum unit 16 forms an electrostatic latent image by a scan of a light beam from the optical unit 20 onto a photosensitive drum. The developing unit 22 develops the electrostatic latent image on the photosensitive drum by using a developing agent. After that, the image is transferred onto the continuous paper which is fed along the paper conveying path 14 and is fixed by a fixing unit 35, thereby printing.

Figure 2:
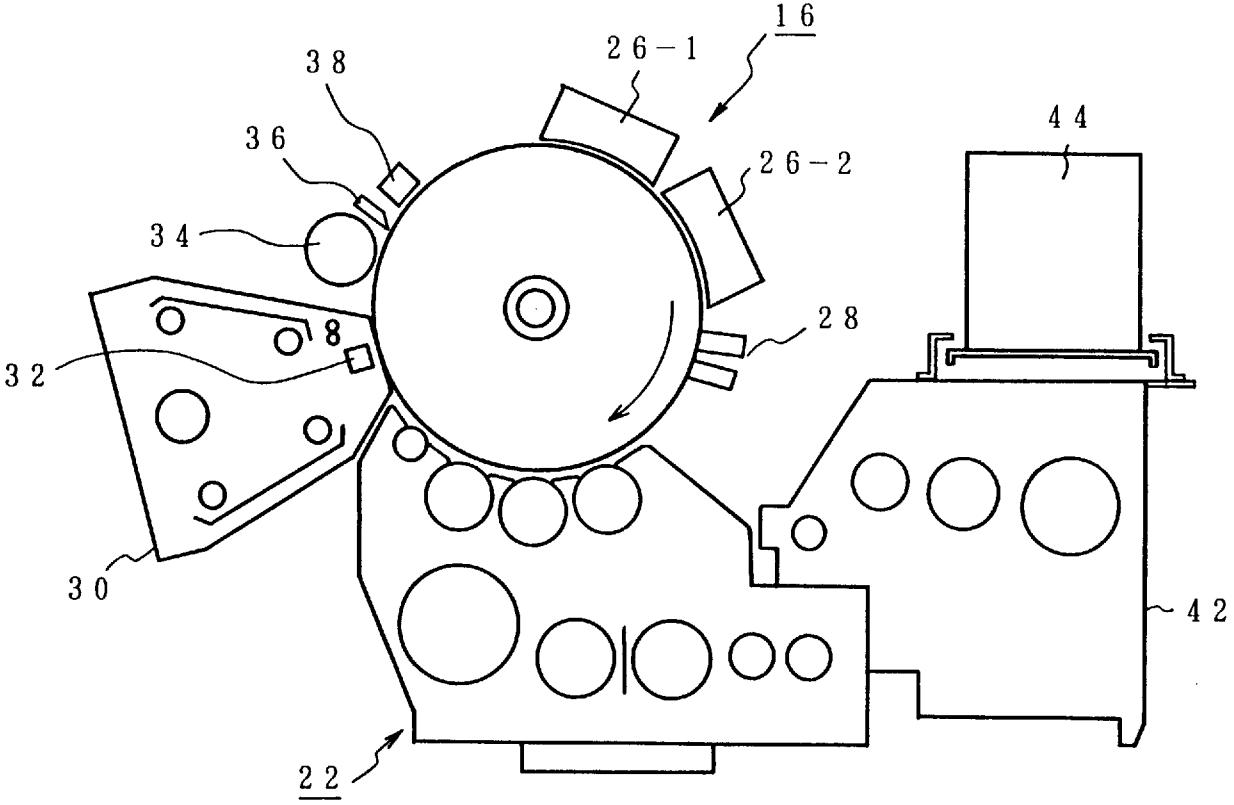
FIG. 2 a detailed explanatory diagram of a photosensitive drum and a developing unit in FIG. 1.

FIG. 2 shows a detailed structure of the photosensitive drum unit 16 and developing unit 22 in FIG. 1. A photosensitive drum 18 is rotated counterclockwise at a predetermined speed by a motor (not shown). Two pre-charging units 26-1 and 26-2 are installed around the photosensitive drum 18 on the right side of the upper portion, thereby uniformly charging the surface of the photosensitive drum 18. Subsequently, an LED print head 28 is provided. An LED array in which a number of LEDs are arranged in the longitudinal direction of the drum is used as an LED print head 28. A print pattern is exposed by a light emission driving of the LED array according to print information, thereby forming an electrostatic latent image onto the photosensitive drum 18. The electrostatic latent image formed on the photosensitive drum 18 is developed by toner components of a 2-component developing agent containing carrier and toner at the position of the developing unit 22 and becomes a toner image. On the other hand, the continuous paper to print is sent to a transfer position of the photosensitive drum 18 by a paper conveying unit 30. A transfer charging unit 32 is arranged at the transfer position so as to face the photosensitive drum 18. The toner image on the photosensitive drum 18 is transferred onto the paper by the transfer charging unit 32. The toner image transferred onto the paper is fixed by the fixing unit 35 shown in FIG. 1. A thermal fixing unit for fixing by a heat, a flash fixing unit for fixing by the light, a pressure fixing unit for fixing by a pressure, or the like can be used as a fixing unit 35. The residual toner remaining without being transferred exists on the photosensitive drum 18 after completion of the transfer of the toner image onto the paper by the transfer charging unit 32. A cleaning brush 34 is provided to remove the residual toner, thereby mechanically removing the residual toner on the photosensitive drum 18. Subsequently, a discharging LED 38 is provided, thereby performing a discharging process to return an electric potential on the photosensitive drum 18 to a zero volt in an initial state. A two-component developing agent comprising a toner component consisting of a fine particles of a coloring resin and a magnetic component consisting of fine magnetic carrier is contained in the developing unit 22. The 2-component developing agent comprising the toner component having a mean diameter of, for example, 10 $\mu$m and the magnetic carrier having a mean diameter of 80 $\mu$m is used. The toner is supplied from a toner hopper 42 to the developing unit 22. For example, by setting a toner cartridge 44 to an upper portion, the toner of a specified amount, for example, 600 g can be filled into the toner hopper 42. As will be obviously understood from the following description, when a detection value of a toner density sensor provided for the developing unit 22 is equal to or less than a specified value, the toner is supplied from the toner hopper 42 to the developing unit 22 by driving a toner supply roller provided for the toner hopper 42 at a specified rotational speed for a specified time.

Figure 3:
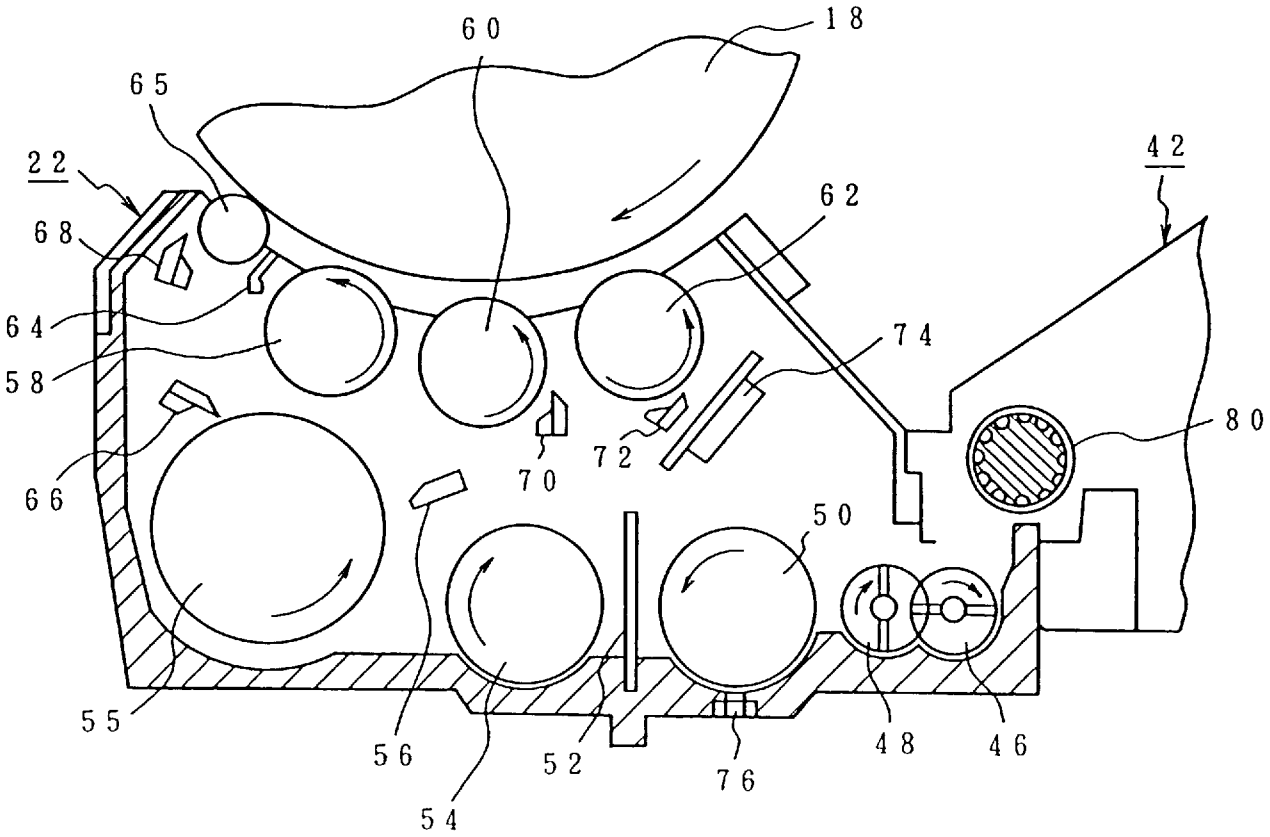
FIG. 3 is a structural explanatory diagram of the developing unit in FIG. 2.

FIG. 3 is a detailed structure of the developing unit 22 in FIG. 2. The inside of a container of the developing unit 22 is divided to right and left portions by a partition wall 52 at the center of a bottom portion. Pre-stirring rollers 46 and 48 and a screw roller 50 are arranged on the right toner supplying side. The toner is supplied to installing portions of the pre-stirring rollers 46 and 48 from a toner supply roller 80 provided for the toner hopper 42 installed on the right side. The toner supplied from the toner hopper 42 is sent to the screw roller 50 side by the clockwise rotations of the pre-stirring rollers 46 and 48 and is sent in the axial direction by the counterclockwise rotation of the screw roller 50 and is fed to the left side of the partition wall 52 at an axial end. A screw roller 54 is arranged on the left side of the partition wall 52. The screw roller 54 is rotated clockwise in the reverse direction for the screw roller 50, thereby feeding the toner in the axial direction opposite to that of the screw roller 50. The 2-component developing agent is circulated in the developing unit 22 by the rotation in the reverse directions of the screw rollers 50 and 54. The toner component and the magnetic carrier component are mutually frictionally charged by stirring. A magnet roller is used for a conveyer roller 55. The magnetic carrier is adsorbed around the conveyer roller 55, thereby forming a magnetic brush. The toner component is electrostatically adhered to the ears of the magnetic brush, thereby supplying the toner component to each of a first development magnet roller 58, a second development magnet roller 60, and a third development magnet roller 62 arranged around the photosensitive drum 18 in the upper portion, respectively. A length of each ear of the developing agent of the magnetic brush which is formed on the conveyer roller 55 is restricted by a pre-doctor blade 56. The supply of the developing agent to the conveyer roller 55 by the screw rollers 50 and 54 is restricted by a flow guide plate 74. A length of each ear of the magnetic brush formed on each roller is restricted by scrapers 66, 68, 70, and 72. Further, a doctor blade 64 is arranged around the first developing magnet roller 58. A length of each ear of the toner component by the magnetic brush of the first magnet roller 58 is restricted by the doctor blade 64, thereby uniforming a developing density of the toner image for the photosensitive drum 18. The first to third development magnet rollers 58, 60, and 62 are rotated counterclockwise in the same direction as that of the photosensitive drum 18 and a peripheral speed of each of them is set to a speed that is, for example, twice as high as a peripheral speed of the photosensitive drum 18. For the movement of the electrostatic latent image by the rotation of the photosensitive drum 18, the development is sequentially performed in accordance with the order of the third development magnet roller 62, second development magnet roller 60, and first development magnet roller 58. Finally, a collecting magnet roller 65 is provided, thereby removing the unnecessary toner component of the developed toner image. A toner density sensor 76 is arranged in the lower portion of the screw roller 50 of the bottom portion of the developing unit 22. The toner density sensor 76 detects a toner density of the 2-component developing agent in the developing unit 22 and generates a detection signal.

Figure 4:
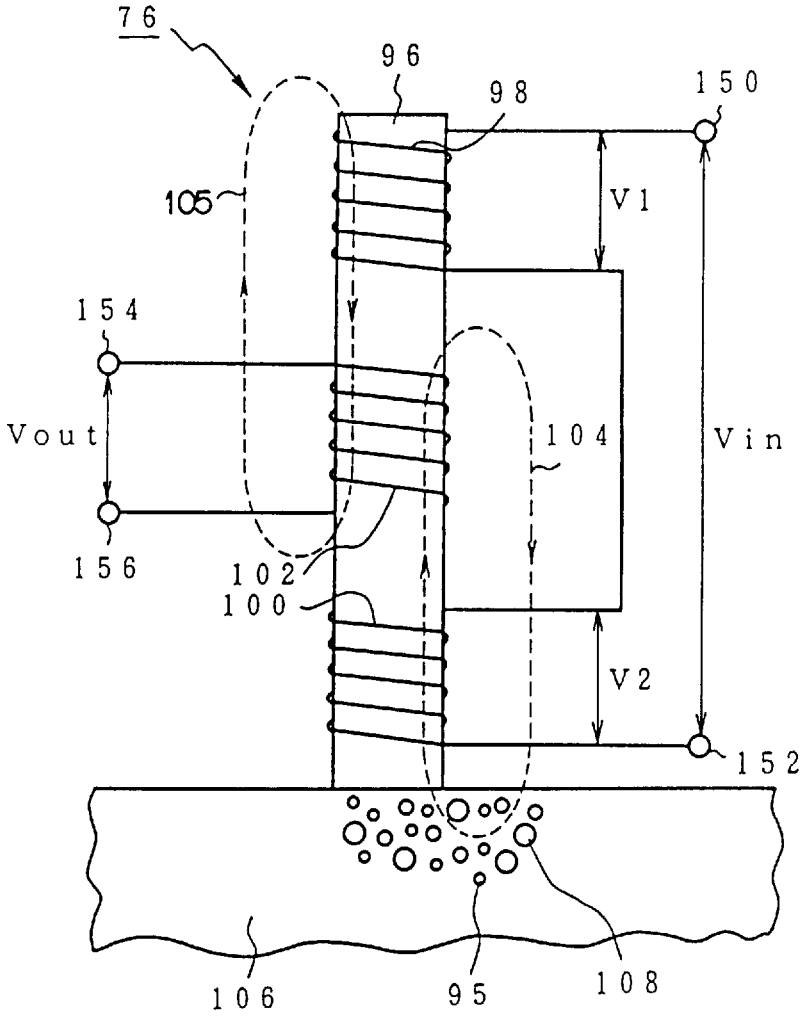
FIG. 4 is an explanatory diagram of a toner density sensor provided for the developing unit in FIG. 3.

FIG. 4 shows the toner density sensor 76 in FIG. 3. According to the toner density sensor 76, input windings 98 and 100 are wound on both sides around a core 96 and are serially connected and an output winding 102 is wound between them. The operation of the toner density sensor 76 is performed by applying a specified DC voltage Vin to a portion between input terminals 150 and 152. When the input voltage Vin is applied, divided voltages V1 and V2 are applied to the input windings 98 and 100, respectively, and a specified input current flows. Therefore, a magnetic flux 105 passing through the portion of the output winding 102 is formed by the input winding 98. At the same time, a magnetic flux 104 passing in a developing agent 106 is formed by the input winding 100. An intensity of the magnetic flux 104 passing in the developing agent 106 is changed by carrier 108 serving as a magnetic component of the developing agent 106 and toner 95. That is, when a quantity of toner 95 is large, a permeability decreases. When the quantity of toner 95 is small, the permeability is raised. When the permeability is low because the quantity of toner 95 is large, a sensor output voltage Vout from output terminals 154 and 156 by the output winding 102 is low. On the contrary, when the quantity of toner 95 decreases and the permeability is raised, the output voltage Vout of the output winding 102 rises. That is, the toner density sensor 76 generates a detection output according to a ratio between the carrier 108 and toner 95 constructing the developing agent 106 as a toner density detection signal.

Figure 5:
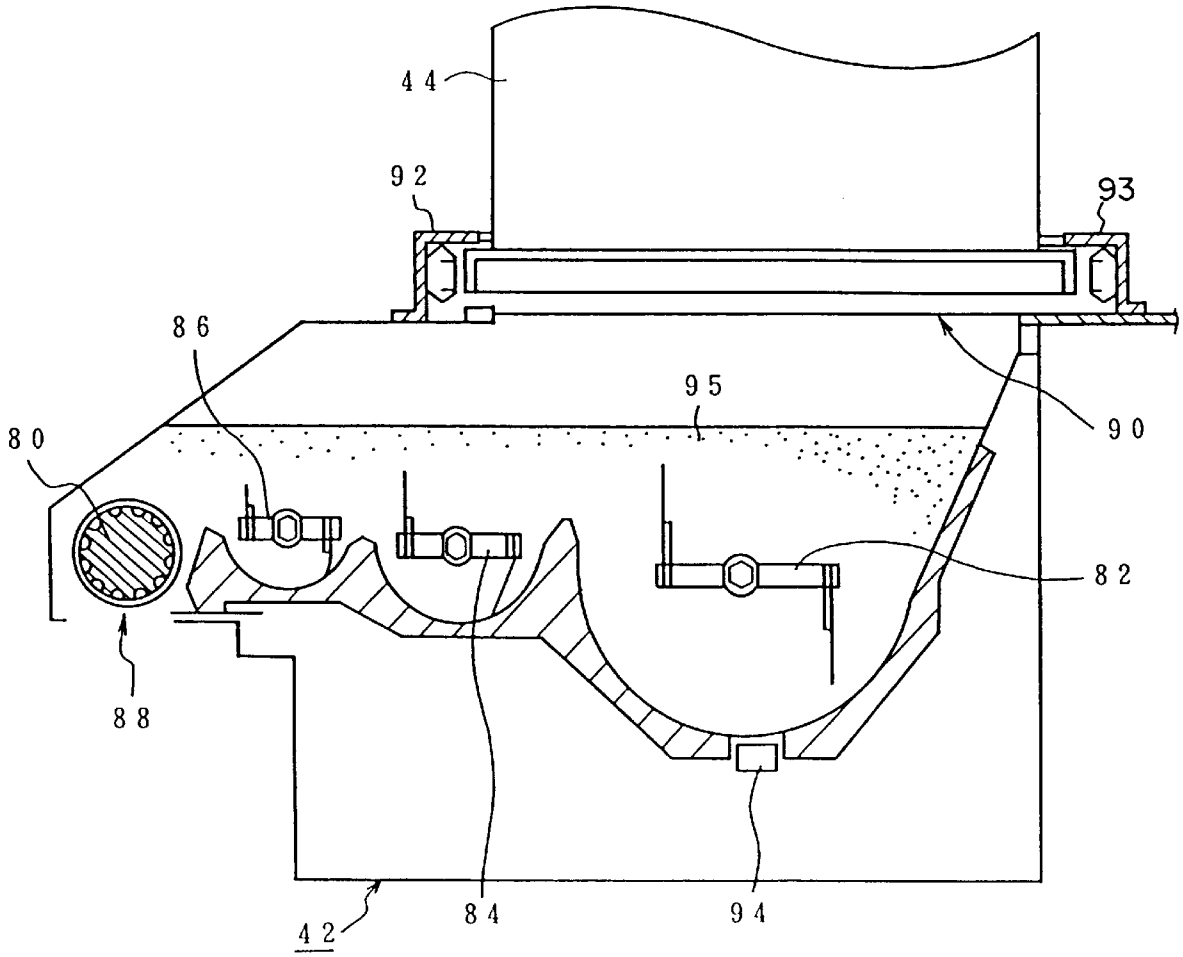
FIG. 5 is a structural explanatory diagram of a toner hopper in FIG. 2.

FIG. 5 shows a detailed structure of the toner hopper 42 in FIG. 2. The toner hopper 42 has a cartridge attaching portions 92 and 93 in the upper portion. When the toner cartridge 44 is attached to the cartridge attaching portion 92 and 93 as shown in the diagram and a seal 90 which closes the lower portion of the toner cartridge 44 is peeled off, a predetermined specified amount (W) (for example, W=600 g) of toner 95 can be filled into the toner hopper 42. Agitators 82, 84, and 86 are laterally arranged in the toner hopper 42 into which the toner 95 was filled from the toner cartridge 44. The toner supply roller 80 is arranged in the portion of a toner supply port 88 opening in the lower portion of a projecting portion on the left side. A plurality of grooves in the axial direction are formed on the outer periphery of the toner supply roller 80. The toner supply amount from the toner hopper 42 to the developing unit can be determined by a rotational speed and a rotating time. Rotational radii of the agitators 82, 84, and 86 are sequentially set to be smaller from the right side to the left side. When the toner is supplied by the rotation of the toner supply roller 80, the agitators 82, 84, and 86 are rotated counterclockwise, thereby feeding the toner 95 to the toner supply roller 80 side. A specified value w0 of the toner supply amount of one time of the toner that is fed to the developing unit by the driving of the toner supply roller 80 is determined to, for example, w0=0.5 g. A toner sensor 94 is arranged to the bottom portion of the agitator 82 provided for the toner hopper 42. A transmitting type sensor or a piezoelectric sensor can be used as a toner sensor 94. The toner sensor 94 is used to discriminate a toner near empty state when the toner 95 filled in the toner hopper 42 approaches a state in which it is extinguished or a toner empty state in which the toner is extinguished.

Figure 6:
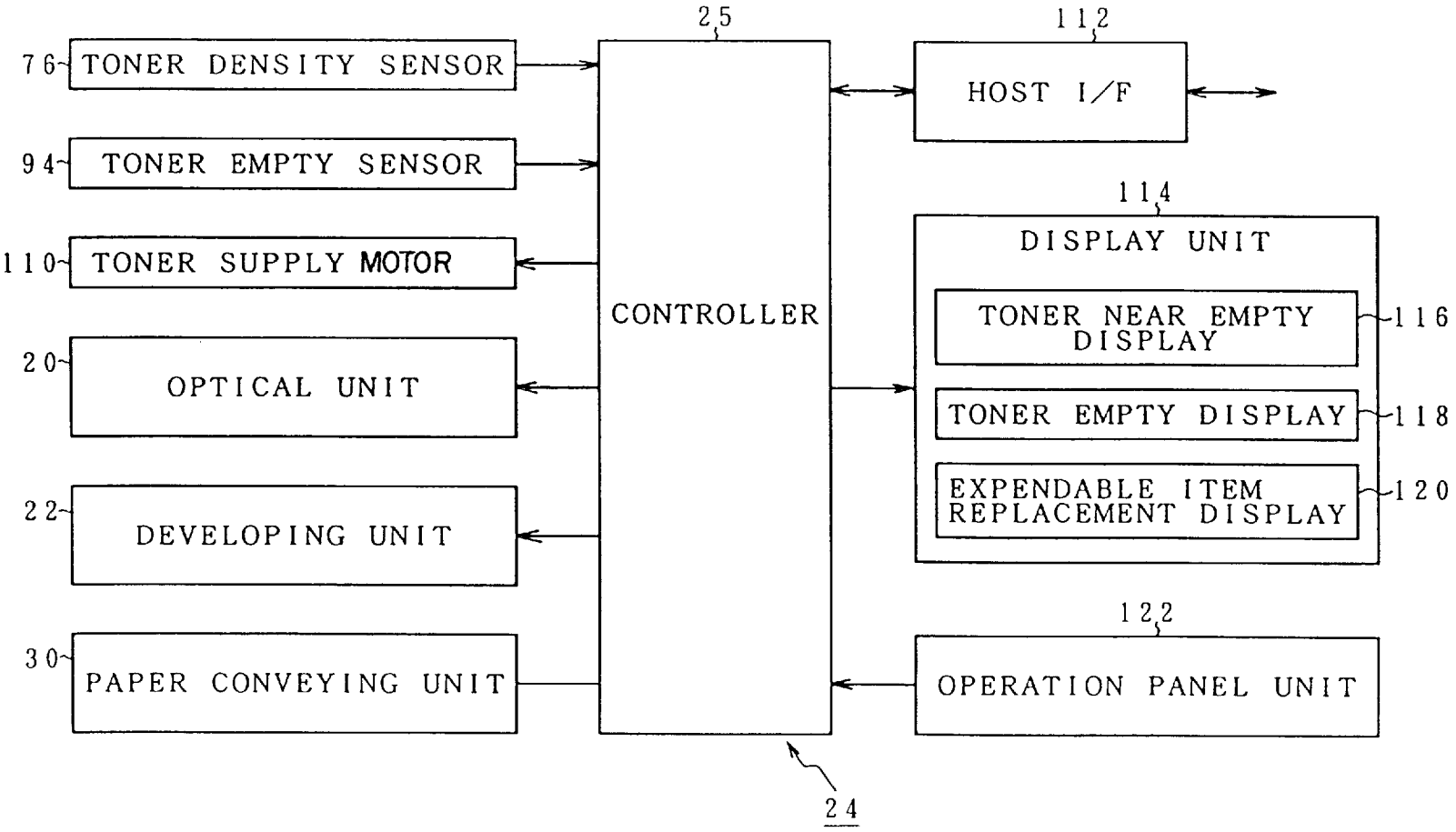
FIG. 6 is a block diagram of a control unit in FIG. 1.

FIG. 6 is a block diagram of the control unit 24 in FIG. 1. A controller 25 using an MPU is provided for the control unit 24. The toner density sensor 76 provided for the developing unit 22 in FIG. 3 and the toner sensor 94 provided for the toner hopper 42 in FIG. 5 are connected to the controller 25. A toner supply motor 110 to drive the toner supply roller 80 provided in FIG. 5 is connected. The optical unit 20, developing unit 22, paper conveying unit 30, or the like shown in FIG. 1 are also connected. Further, the controller is connected to an upper host computer through a host interface 112 and can receive print information. A display unit 114 and an operation panel unit 122 are provided for the controller 25. In the invention, a toner near empty display 116, a toner empty display 118, and an expendable item replacement display 120 are provided for the display unit 114. Display lamps such as independent LEDs or the like can be also used as such displays. Messages indicative of a toner near empty, a toner empty, and an expendable item replacement can be also displayed onto the liquid crystal display by characters. Further, numbers indicative of the toner near empty, toner empty, and expendable item replacement can be also displayed. Various operation switches necessary for the operation of the page printer 10 in FIG. 1 are provided for the operation panel unit 122.

Figure 7:
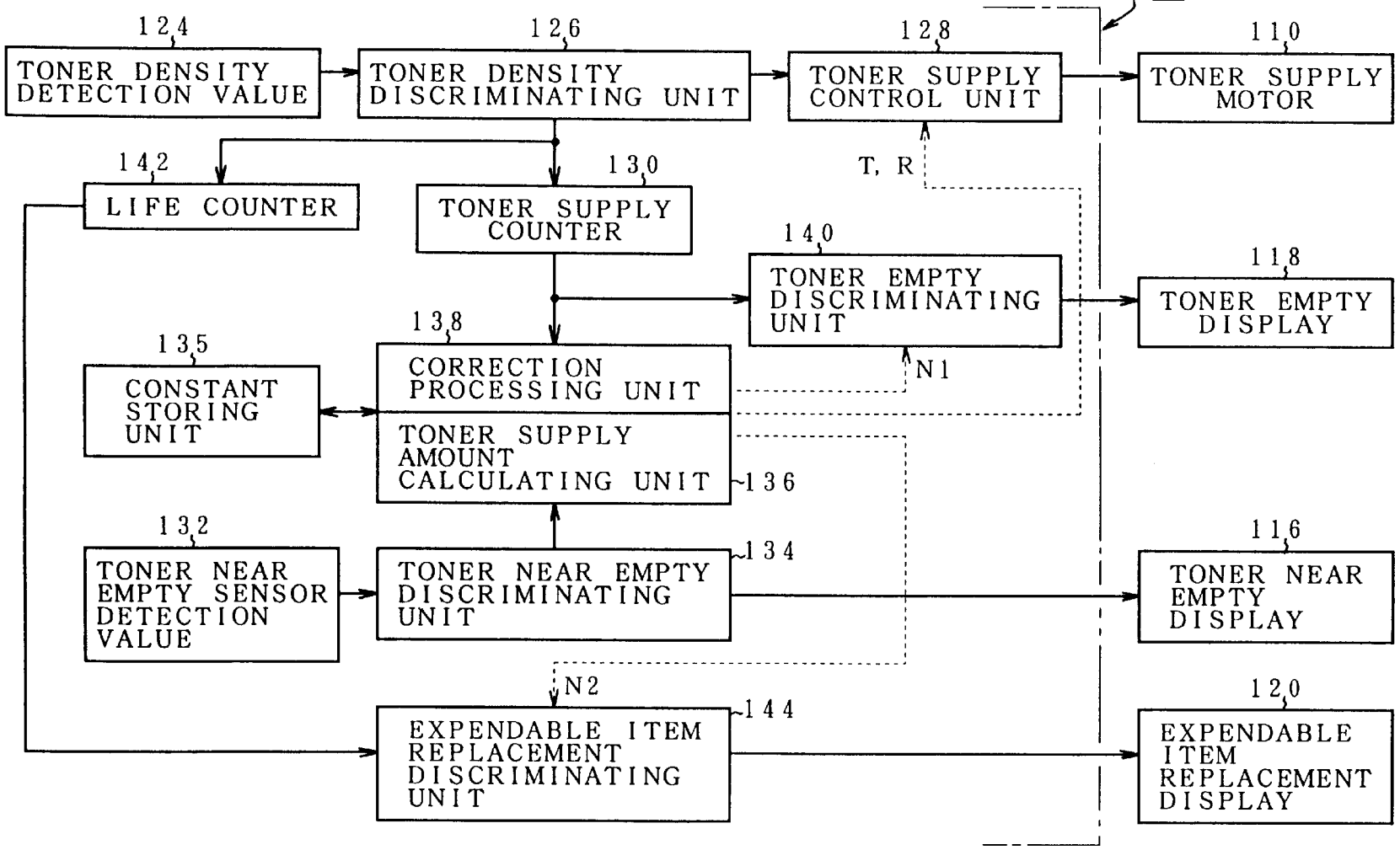
FIG. 7 is a functional block diagram of a controller in FIG. 6 according to an embodiment of the invention.

FIG. 7 is a functional block diagram for a detection discriminating process about the number of toner supplying times in the electrophotographying apparatus of the invention which is realized by the controller 25 in FIG. 6. First, a register 124, a toner density discriminating unit 126, and a toner supply control unit 128 are provided for the controller 25 for the purpose of a control of the toner supply motor 110 to supply the toner to the developing unit 22 by driving the toner supply roller 80 provided for the toner hopper 42 in FIG. 5. A toner density detection value of the toner density sensor 76 provided for the developing unit 22 in FIG. 3 is stored into the register 124. The toner density discriminating unit 126 compares a predetermined discrimination reference value of a decrease in toner density with the toner density detection value stored in the register 124. When the detection value is equal to or less than the discrimination value of the decrease in toner density, the toner density discriminating unit 126 determines the reduction of the toner density and activates a toner supply control unit 128. A rotational speed (R) and a supply operation time (T) of the toner supply motor 110 for supplying the specified toner supply amount w0 (for example, w0=0.5 g) of toner which has been predetermined by a constant storing unit 135 by one time are set in the toner supply control unit 128. Therefore, when the discrimination output of the reduction of the toner density is received from the toner density discriminating unit 126, the toner supply control unit 128 drives the toner supply motor 110 at the specified rotational speed (R) and for the specified operation time (T), thereby supplying the preset specified toner supply amount (w0=0.5 g) of toner to the developing unit 22 by one time. However, the actual toner supply amount is not always equal to the specified toner supply amount w0=0.5 g. There is a variation time is in the toner supply amount of one time is increased or decreased in accordance with an environmental humidity of the apparatus. A register 132 and a toner near empty discriminating unit 134 are provided for the controller 25. The toner detection value of the toner sensor 94 provided for the toner hopper 42 in FIG. 6 is stored into the register 132. The toner near empty discriminating unit 134 compares a predetermined specified discrimination value of the toner near empty with the detection value stored in the register 132. When the detection value is equal to or less than the discrimination value, the toner near empty discriminating unit 134 determines a toner near empty state in which the toner in the toner hopper approaches an empty state, thereby allowing the toner near empty display unit 116 to display a message to promote a replacement of the toner cartridge. On the other hand, the number of times of the toner supply which is performed by activating the toner supply control unit 128 when the toner density discriminating unit 126 discriminates the decrease in toner density is counted by a toner supply counter 130. It is now assumed that a count value of the toner supply counter 130 is set to (X). As shown in FIG. 5, when the toner cartridge 44 is set into the toner hopper 42 and the toner is filled therein, the toner supply counter 130 is reset to X=0. After that, the counter 130 is counted up each time the decrease in toner density for the toner supply is discriminated by the toner density discriminating unit 126. The count value (X) of the toner supply counter 130 is sent to a toner empty discriminating unit 140. A specified number N1 of discriminating times to discriminate the toner empty state is set into the toner empty discriminating unit 140 from the constant storing unit 135. Therefore, when the count value (X) of the toner supply counter 130, namely, the number (X) of toner supplying times reaches the specified number N1 of toner empty discriminating times, the toner empty discriminating unit 140 decides the toner empty state, generates a discrimination output, and drives the toner empty display unit 118 so as to display a replacement, thereby requesting for the operator to replace the toner cartridge. The number of toner supplying times based on the reduction of the toner density discriminated by the toner density discriminating unit 126 is also counted by a life counter 142 provided to discriminate a life of an expendable item. A count value of the life counter 142 now assumes (Y). The count value (Y) of the life counter 142 is sent to an expendable item replacement discriminating unit 144. A number N2 of discriminating times of replacement of an expendable item to decide an expandable item replacement period which has been preset by the constant storing unit 135 is set in the expandable item replacement discriminating unit 144. Therefore, when the count value (Y) of the life counter 142 reaches the number N2 of replacement discriminating times, the expendable item replacement discriminating unit 144 determines the replacement of the expendable item and generates a discrimination output. The discriminating unit 144 drives the expendable item replacement display unit 120 so as to display, thereby requesting for the operator to replace the expendable item. As expendable items to be discriminated by the expendable item replacement discriminating unit 144, there are the cleaning brush 34 and a cleaning blade 36 which are provided for the photosensitive drum unit 16 in FIG. 3 and in which each life depends on the toner supply amount. Further, there are a toner collecting filter, a desmoke filter in case of using the flash fixing unit, a toner collecting filter in case of using a cleaning blower, and the like. Various constants necessary for the detection discriminating process about the number of toner supplying times of the invention have previously been stored in the constant storing unit 135. A non-volatile memory which can hold storage contents even if a power supply of the apparatus is shut off is used as a constant storing unit 135.

FIG. 8 shows the storage contents in the constant storing unit 135 in FIG. 7. The toner cartridge filling amount (W), the specified toner supply amount w0 of one time by the driving of the toner supply roller, the toner supply operation time (T) and toner supply rotational speed (R) as control parameters by the toner supply control unit 128, the number N1 of toner empty discriminating times, and the number N2 of expendable item life discriminating times are determined in the constant storing unit 135. For example, in this case, W=600 g, w0=0.5 g/time, T=600 msec, R=6 rpm, N1=1200 times, and further, N2=6000 times have been stored as constants.

Referring again to FIG. 7, a toner supply amount calculating unit 136 and a correction processing unit 138 are provided subsequent to the constant storing unit 135. When the toner near empty is determined from the detection value of the toner sensor by the toner near empty discriminating unit 134, the toner supply amount calculating unit 136 is activated and fetches the number (X) of toner supplying times of the toner supply counter 130 at that time. On the basis of the filling amount (W) of the toner cartridge which is given from the constant storing unit 135, the toner supply amount calculating unit 136 calculates the toner supply amount (w) of one time so far when the toner near empty is decided by the following equation.

$$w=W/X$$

For example, when the number (X) of toner supplying times of the toner supply counter 130 when the toner near empty is determined in case of the toner filling amount (W=600 g) is equal to X=1000 times, the toner supply amount (w) of one time at that time is $$w=W/X=600/1000=0.6 \text{ g/time}$$

The correction processing unit 138 obtains a correction coefficient (K) as a ratio (w0/w) between the specified toner supply amount w0 of one time which is given from the constant storing unit 135 and the actual toner supply amount (w) of one time calculated by the toner supply amount calculating unit 136. The toner supply rotational speed (R) and toner supply operation time (T) serving as control parameters of the toner supply control unit 128, the number N1 of discriminating times which is set to the toner near empty discriminating unit 140, or the number N2 of discriminating times which is set to the expendable item replacement discriminating unit 144 is corrected by using the correction coefficient (K). There are two modes of a correction mode 1 and a correction mode 2 for the correction by the correction processing unit 138. In the correction mode 1, the toner supply rotational speed (R) or toner supply operation time (T) serving as a control parameter set in the toner supply control unit 128 is corrected so as to make the actual toner supply amount (w) coincide with the specified toner supply amount w0 set in the constant storing unit 135. On the other hand, in the correction mode 2, the toner supply rotational speed (R) and toner supply operation time (T) of the toner supply control unit 128 are not corrected but each of the number N1 of discriminating times for the toner empty discriminating unit 140 and the number N2 of discriminating times for the expendable item replacement discriminating unit 144 is corrected. In the correction mode 1 to correct the control parameter of the toner supply control unit 128, either one of the toner supply rotational speed (R) and the toner supply operation time (T) is corrected. That is, in case of correcting the toner supply rotational speed (R), the specified supply rotational speed (R) stored in the constant storing unit 135 at that time is multiplied by the correction coefficient K=(w0/w), thereby correcting to (K·R). For example, when the specified toner supply amount w0=0.5 g/time and the calculated toner supply amount w=0.6 g/time, the correction coefficient K=⅚ is obtained. By multiplying it by the present supply rotational speed R=6 rpm, the correction rotational speed R=5 rpm is obtained and is set into the toner supply control unit 128. Therefore, in the subsequent toner supply control, the number of toner supply rotational speed is reduced from 6 rpm so far to 5 rpm. The toner supply amount of one time, namely, 0.6 g/time is corrected to w=0.5 g/time serving as a specified toner supply amount. Even in case of correcting the toner supply operation time (T) in the correction mode 2, similarly, for example, when the correction coefficient K=⅚, by multiplying it by the specified toner supply operation time T=600 msec, 500 msec is obtained as a corrected toner supply operation time and is set into the toner supply control unit 128. Therefore, in the subsequent toner supply control, the toner supply operation time 600 msec so far decreases to 500 msec. The toner supply amount can be adjusted from 0.6 g/time so far to 0.5 g/time that is coincident to the specified toner supply amount. On the other hand, in the process such that the rotational speed (R) and supply operation time (T) of the toner supply control in the correction mode 2 are not corrected each of the number N1 of discriminating times of the toner empty and the number N2 of discriminating times of the expendable item replacement in the constant storing unit 135 is multiplied by the correction coefficient (K), thereby correcting. For instance, assuming that the correction coefficient K=w0/w=⅚, the number N1 of toner empty discriminating times (N1=1200 times) set by the constant storing unit 135 is multiplied by the correction coefficient K=⅚, thereby correcting to N1=1000 times. As for the correction of the number N1 of toner empty discriminating times, it is apprehended that if the discrimination of the toner empty is too early, the toner overflows to the outside due to the filling of the toner by the setting of the toner cartridge and the inside of the apparatus is made dirty. Therefore, the correction value is further multiplied by a predetermined delay coefficient (A), thereby setting the corrected number of toner empty discriminating times to a larger value. For instance, the delay coefficient (A) is set to a value larger than 1. If it is set to A=1.2, by multiplying the value (1000 times) as a corrected number of toner empty discriminating times by the delay coefficient (A), it is corrected to, for example, 1200 times. When the number N2 of discriminating times of the expendable item replacement is equal to, e.g., N2=6000 times, by multiplying it by the correction coefficient K=⅚, it can be corrected to the number of discriminating times of the expendable item replacement of 5000 times. That is, the number N1 of toner empty discriminating times and the number N2 of discriminating times of the expendable item replacement are corrected to the values adapted to the actual toner supply amount w0 per time calculated by the toner supply amount calculating unit 136. Thus, even if there is a variation in the toner supply amount of one time, the discrimination of the timing of the toner empty and the timing for replacing the expendable item can be more accurately realized.

[Calculation of toner supply amount by toner near empty detection]

Figure 9A:
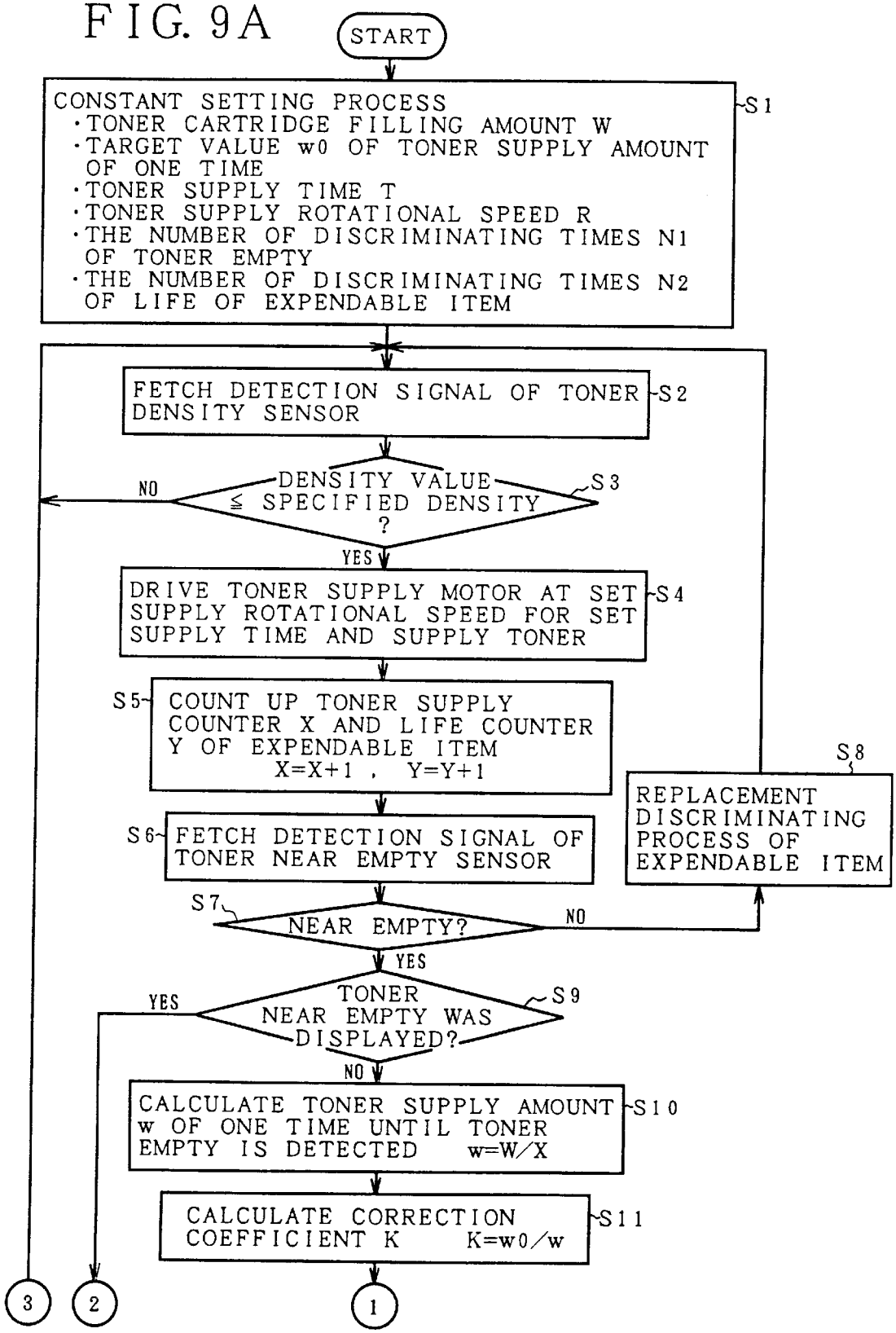
FIGS. 9A and 9B are flowcharts for a detection discriminating process of the number of toner supplying times of the invention by the controller in FIG. 6.
Figure 9B:
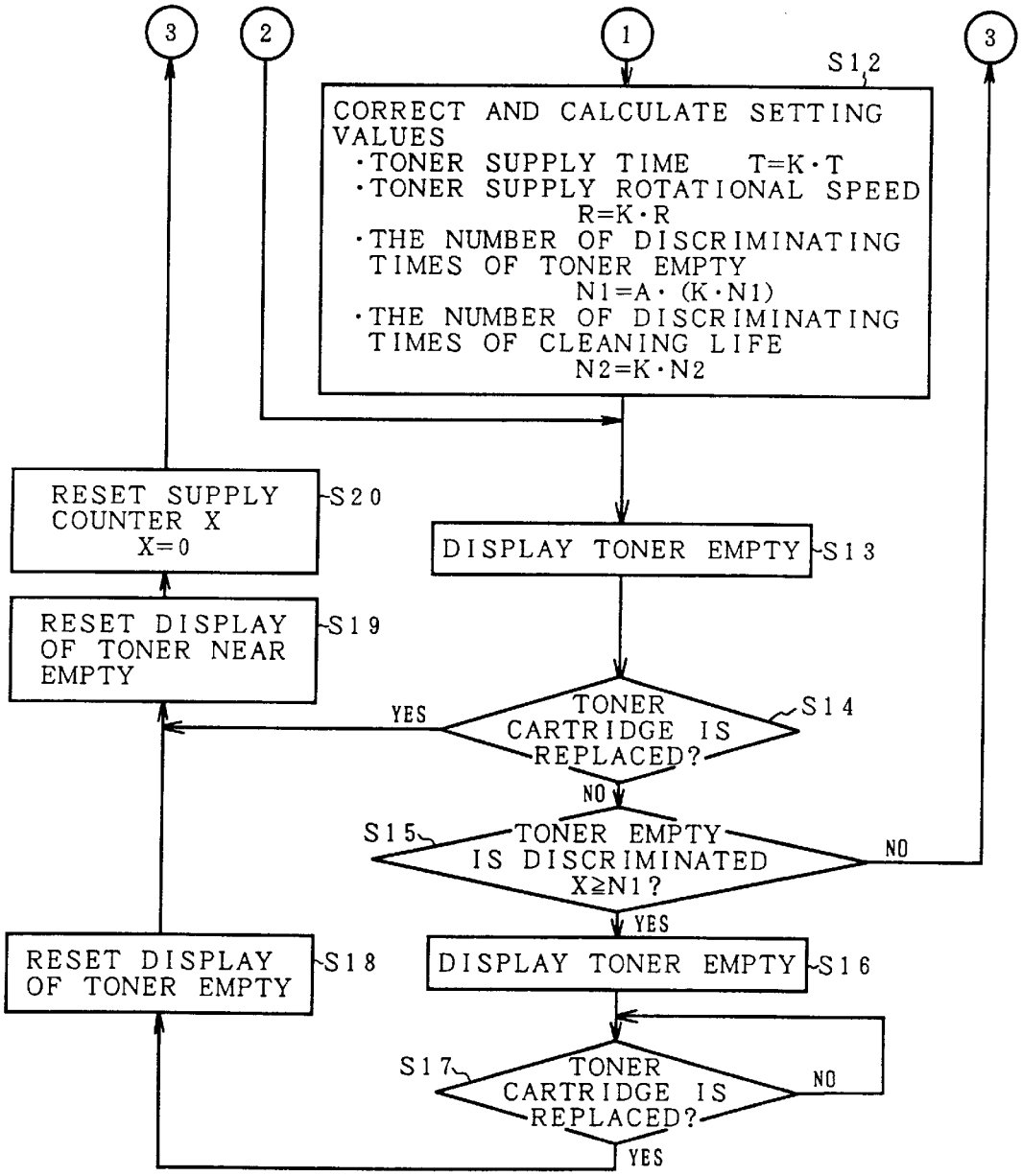

FIGS. 9A and 9B are flowcharts for the detection discriminating process of the toner supply amount of the invention according to the functional block diagram of FIG. 7. First in step S1, a setting process of constants having the contents of FIG. 8 is executed. Specifically speaking, the constants at that time when they are stored in the constant storing unit 135 as a non-volatile memory are read out at the time of turn-on of a power supply of the page printer and set into the corresponding control unit or discriminating unit, respectively. In step S2, the detection signal of the toner density sensor 76 provided for the developing unit 22 is fetched as shown in FIG. 3. In step S3, a check is made to see whether it is a predetermined specified density or less or not. When the detection density by the detection signal of the density sensor is equal to or less than the specified density, step S4 follows. The toner supply motor 110 is likewise driven at the supply rotational speed (R) and set supply time (T) which have been set at that time, thereby supplying a specified amount of toner to the developing unit 22 from the toner hopper 42. In step S5, the count value (X) of the toner supply counter 130 and the count value (Y) of the life counter 142 of the expendable item are counted up, respectively. In step S6, the detection signal of the toner sensor provided for the toner hopper 42 in FIG. 5 is fetched and compared with the specified near empty discrimination value, thereby checking whether the toner is near empty or not. If N0, a replacement discriminating process of the expendable item in step S8 is executed. The processing routine is again returned to step S2. The processes in steps S2 to S6 are repeated. When the near empty is determined in step S7, step S9 follows and a check is made to see if the toner near empty has been displayed. In the discrimination of the first near empty, since the near empty is not displayed, step S10 follows. The toner supply amount (w) of one time until the detection of the toner near empty is calculated from the filling amount (W) by the toner cartridge and the count value (X) of the toner supply counter 130. In step S11, the correction coefficient (K) is calculated. Step S12 in FIG. 9B follows and a correcting operation of the set value is performed. The correcting operation is executed in either the correction mode 1 to correct either one of the toner supply time (T) and toner supply rotational speed (R) or the correction mode 2 to correct the number N1 of toner empty discriminating times and the number N2 of life discriminating times. In step S13, the toner near empty is displayed. In the discrimination of the toner near empty of the second and subsequent times in step S9 in FIG. 9A, steps S10 to S12 are skipped and the processing routine advances to step S14 in FIG. 9B. In step S14, a check is made to see if the toner cartridge is replaced in response to a replacement request of the toner cartridge to the operator by the display of the toner empty in step S12. When the toner cartridge is replaced in response to the display of the toner empty, step S19 follows and the display of the toner near empty is reset. The count value (X) of the toner supply counter 130 is reset to X=0. After that, the processing routine is again returned to step S2 in FIG. 9A and the processes are repeated. When the toner cartridge is not replaced in step S14, step S15 follows and a discriminating process of the toner empty is performed. In the discrimination of the toner empty, the corrected number of toner empty discriminating times is used in case of the correction mode in step S12. In step S15, when the count value (X) of the toner supply counter 130 reaches the number N1 of toner empty discriminating times, step S16 follows and the toner empty is displayed, thereby requesting the replacement of the toner cartridge. For the display of the toner empty, the replacement of the toner cartridge is monitored in step S17. The processing routine is interrupted until the cartridge is replaced. When the operator replaces the toner cartridge in response to the display of the toner empty, the processing routine advances from step S17 to step S18 and the display of the toner empty is reset. After that, the display of the toner near empty is reset in step S19. Further in step S20, the toner supply counter (X) is reset. The processing routine is returned to step S2 in FIG. 9A and the processes are repeated.

Figure 10:
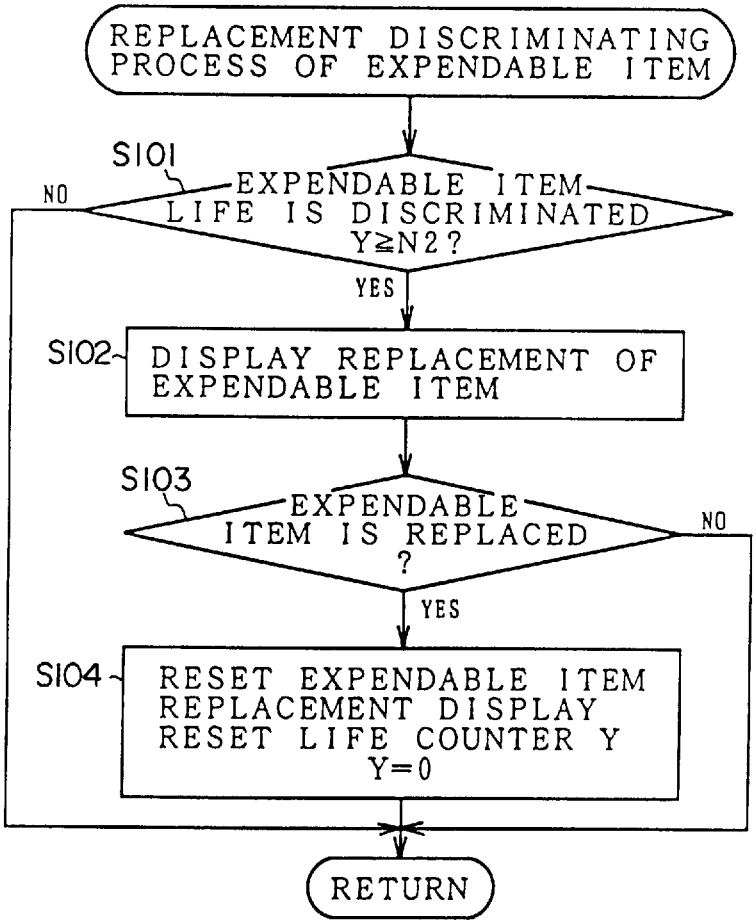
FIG. 10 is a flowchart for a replacement discriminating process of an expendable item of the invention by the controller in FIG. 6.

FIG. 10 shows the details of the discriminating process of the replacement of the expendable item shown in step S8 in FIG. 9A. In the expendable item replacement discriminating process, the count value (Y) of the life counter 142 of the expendable item is compared with the set number N2 of life discriminating times of the expendable item in step S101. When the number (Y) of toner supplying times of the life counter reaches the number N2 of discriminating times, step S102 follows. The replacement of the expendable item is displayed, thereby requesting for the operator to replace the expendable item. In step S103, the replacement of the expendable item is checked. When the expendable item is replaced, the display of the replacement of the expendable item is reset in step S104 and the count value (Y) of the life counter 142 is reset. The processing routine is returned to the main routine in FIG. 9A.

[Calculation of the toner supply amount by the detection of toner empty]

Figure 11:
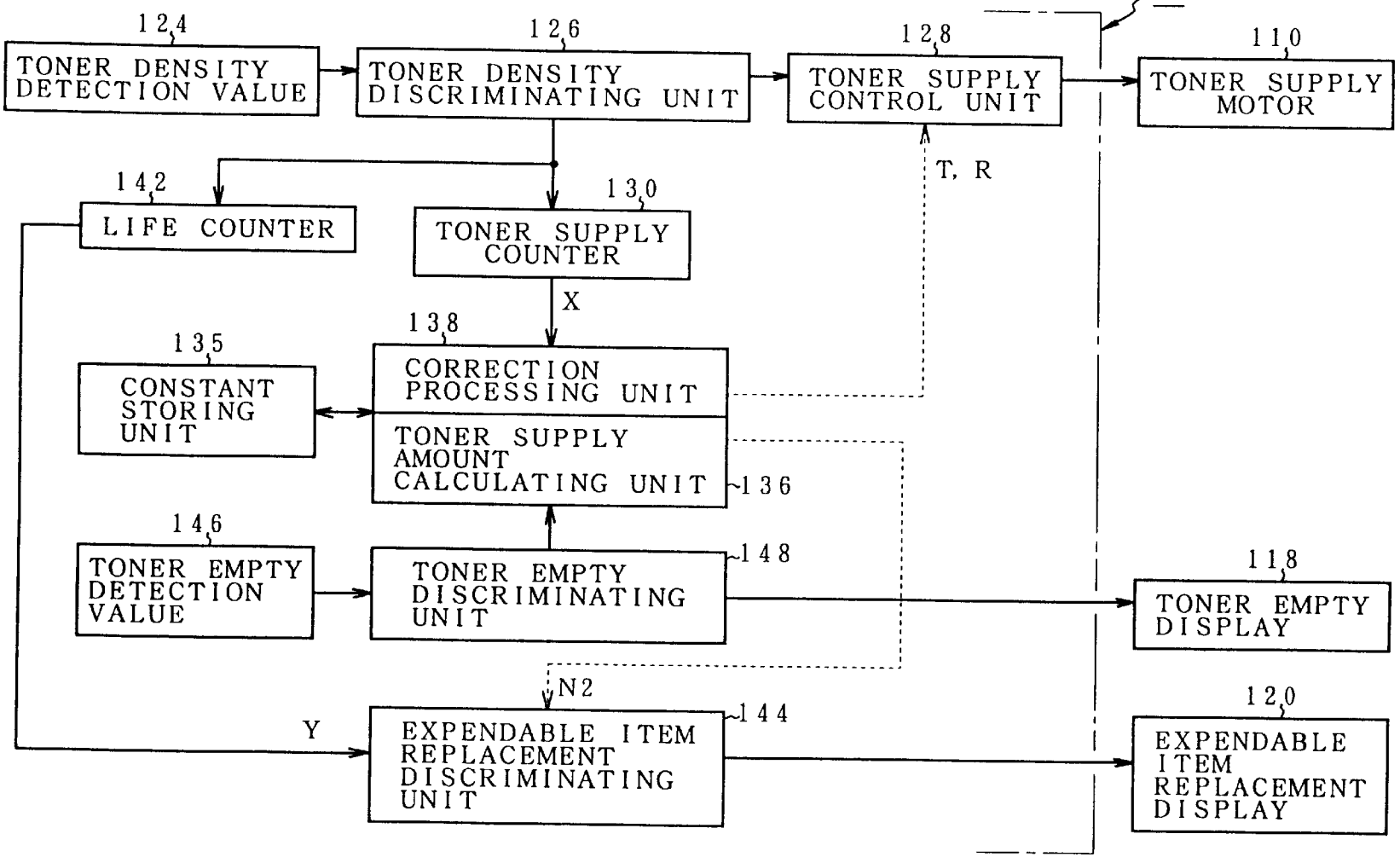
FIG. 11 is a functional block diagram of the controller in FIG. 6 according to another embodiment of the invention.

FIG. 11 is a functional block diagram of another embodiment of the detection discriminating process of the number of toner supplying times in the electrophotographying apparatus of the invention. The embodiment is characterized in that the toner empty is discriminated from the detection signal of the toner sensor 94 provided for the toner hopper 42 in FIG. 5, thereby calculating the toner supply amount of one time and correcting the constants. That is, the register 124 for the toner supply motor 110, toner density discriminating unit 126, toner supply control unit 128, toner supply counter 130 for counting the number of toner supplying times based on the detection of the reduction of the toner density by the toner density discriminating unit 126, life counter 142 of the expendable item, expendable item replacement discriminating unit 144 for the expendable item replacement processing unit 120, further, constant storing unit 135, toner supply amount calculating unit 136, and correction processing unit 138 are the same as those in the embodiment of FIG. 7. On the other hand, in the embodiment of FIG. 11, the register 132, toner near empty discriminating unit 134, and toner near empty display unit 116 in FIG. 7 are removed and a register 146, a toner empty discriminating unit 148, and the toner empty display unit 118 are provided in place of them. The toner empty discriminating unit 148 compares the toner detection value from the toner sensor 94 in FIG. 5 stored into the register 146 with a predetermined specified value for the toner empty discrimination. When the detection value is equal to or less than the specified value, the toner empty discriminating unit 148 generates a toner empty discrimination output and drives the toner empty display unit 118, thereby requesting the operator to replace the toner cartridge. At the same time, the toner supply amount calculating unit 136 is activated by the discrimination output of the toner empty discriminating unit 148, thereby calculating the actual toner supply amount (w) of one time as w=W/X from the count value (X) of the toner supply counter 130 at that time and the toner filling amount (W) from the constant storing unit 135. A calculation result of the toner supply amount is sent to the correction processing unit 138. In a manner similar to the embodiment of FIG. 7, in the correction mode 1, either one of the toner supply rotational speed (R) and toner supply operation time (T) which were set in the toner supply control unit 128 is corrected by the correction coefficient (K) obtained as K=w0/w. In the correction mode 2, the number N2 of replacement discriminating times of the expendable item set in the expendable item replacement discriminating unit 144 is corrected.

Figure 12A:
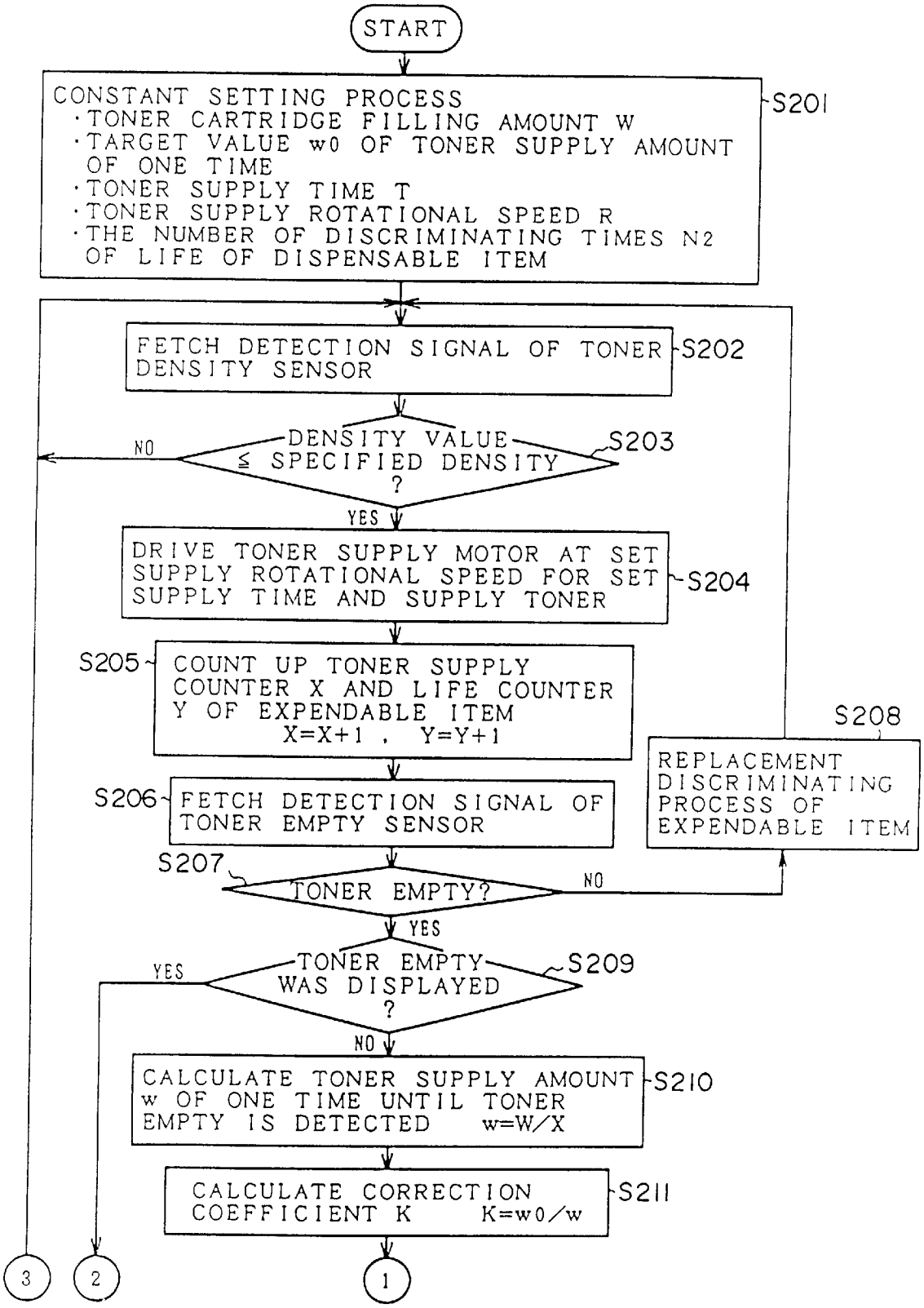
FIGS. 12A and 12B are flowcharts for a detection discriminating process of the number of toner supplying times of the invention by the controller in FIG. 11.
Figure 12B:
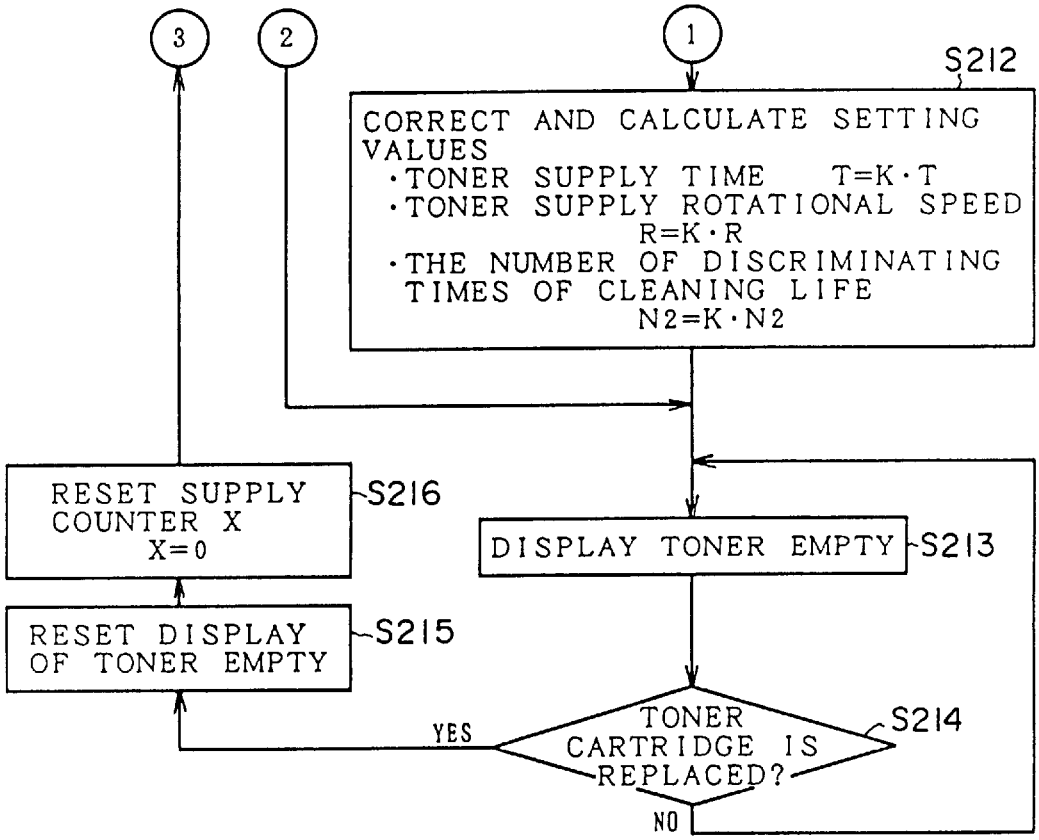

FIGS. 12A and 12B are flowcharts for the detection discriminating process of the number of toner supplying times according to the embodiment of FIG. 11. In the flowcharts, although steps S201 to S206 are the same as S1 to S6 in the flowchart of FIG. 9A, the toner empty is discriminated in step S207 instead of the toner near empty. When the toner empty is discriminated, so long as the toner empty is not displayed yet in step S209, the toner supply amount (w) of one time is calculated in step S210. After that, the correction coefficient (K) is obtained in step S24. A correcting operation of the set value is performed in step S212 in FIG. 12B. The toner empty is displayed in step S213. In step S214, the processes are interrupted until the toner cartridge is replaced. When the toner cartridge is replaced, it is discriminated. The display of the toner empty is reset in step S215. Further in step S216, the count value (X) of the toner supply counter 130 is reset to X=0. After that, the processing routine is returned to step S202 in FIG. 12A and similar processes are repeated. The expendable item replacement discriminating process in step S208 in FIG. 12A is the same as that in the flowchart of FIG. 10.

According to the invention as mentioned above, on the basis of the discrimination value of the toner near empty or the discrimination value of the toner empty, the actual toner supply amount per time is calculated from the count value of the number of toner supplying times so far and the first toner filling amount by the toner cartridge and the apparatus can recognize it. By correcting the toner supply amount per time to the predetermined specified value or by correcting the discrimination value of the number of toner supplying times without changing the toner supply amount, the toner empty or the life timing of the expendable item can be more accurately discriminated. The overflow of the toner due to the filling of the toner when the toner cartridge is set can be certainly prevented. The timing to replace the expendable item such as cleaning blade, cleaning brush, toner collecting filter, or the like can be properly set, the replacement frequency can be reduced, and the running costs of the apparatus can be reduced.

The invention is not limited by the numerical values shown in the above embodiments. Many proper modifications are possible within a scope of the invention without departing from the objects of the invention.

What is claimed is:

1. An electrophotographying apparatus in which an electrostatic latent image formed on a photosensitive material is developed and, thereafter, is transferred onto a paper, comprising:

a developing unit for developing the electrostatic latent image on said photosensitive material by a two-component developing agent composed of toner and carrier;

a toner density sensor for detecting a toner density of said two-component developing agent in said developing unit;

a toner hopper containing the toner to be supplied to said developing unit by receiving a filling of a specified amount of toner by the setting of a toner cartridge;

a toner supplying mechanism for supplying the toner from said toner hopper to said developing unit;

a toner supply control unit for supplying the toner from said toner hopper to said developing unit by driving said toner supplying mechanism each time a detection density of said toner density sensor is equal to or less than a specified value;

a toner sensor for detecting the toner contained in said toner hopper;

a toner near empty discriminating unit for discriminating a toner near empty indicating that the toner approaches an empty state on the basis of a detection value of said toner sensor;

a toner supply counter which is reset at the time of the filling of the toner by the setting of said toner cartridge and counts the number of toner supplying times by said toner supply control unit;

a toner empty discriminating unit for discriminating a toner empty on the basis of a count value of said toner supply counter; and a toner supply amount calculating unit for calculating a toner supply amount per time from the number of toner supplying times of said toner supply counter and a specified toner filling amount by said toner cartridge when said toner near empty is determined.

2. An apparatus according to claim 1, further comprising:

a correction processing unit for correcting control parameters of said toner supply control unit so as to maintain a predetermined specified toner supply amount w0 on the basis of a toner supply amount (w) calculated by said toner supply amount calculating unit.

3. An apparatus according to claim 2, wherein in said toner supply control unit, a rotational speed (R) and a supply operation time (T) of a toner supply roller to supply said specified toner supply amount w0 of toner have been preset as control parameters of said toner supplying mechanism, and said correction processing unit obtains a ratio (w0/w) between said specified toner supply amount w0 and said toner supply amount (w) calculated by said toner supply amount calculating unit as a correction coefficient (K) and multiplies said roller rotational speed (R) by said correction coefficient (K), thereby correcting to a correction roller rotational speed (K·R).

4. An apparatus according to claim 3, further comprising:

a life counter of an expendable item which is reset at the time of replacement of the expendable item and counts the number of toner supplying times by said toner supply control unit; and an expendable item replacement discriminating unit for discriminating a replacement of the expendable item when the number of toner supplying times counted by said life counter reaches a predetermined number N2 of discriminating times of the expendable item replacement, and wherein said correction processing unit obtains a ratio (w0/w) between said specified toner supply amount w0 and said toner supply amount (w) calculated by said toner supply amount calculating unit as a correction coefficient (K) and multiplies said number N2 of replacement discriminating times by said correction coefficient (K), thereby correcting to a correction number (K·N2) of discriminating times.

5. An apparatus according to claim 4, wherein said expendable item replacement discriminating unit discriminates the replacement of expendable items, said expendable items being at least a cleaning blade, cleaning brush, desmoke filter of a flash fixing unit, and toner collecting filter of a cleaning blower.

6. An apparatus according to claim 2, wherein in said toner supply control unit, a rotational speed (R) and a supply operation time (T) of a toner supply roller to supply said specified toner supply amount w0 have been preset as control parameters of said toner supplying mechanism, and said correction processing unit obtains a ratio (w0/w) between said specified toner supply amount w0 and said toner supply amount (w) calculated by said toner supply amount calculating unit as a correction coefficient (K) and multiplies said supply operation time (T) by said correction coefficient (K), thereby correcting to a correction supply operation time (T·R).

7. An apparatus according to claim 1, wherein said toner empty discriminating unit determines the toner empty when the number of toner supplying times counted by said toner supply counter reaches a predetermined number N1 of discriminating times of the toner empty, and said correction processing unit obtains a ratio (w0/w) between a specified toner supply amount w0 and said toner supply amount (w) calculated by said toner supply amount calculating unit as a correction coefficient (K) and multiplies said number N1 of toner empty discriminating times by said correction coefficient (K), thereby correcting to a correction number (K·N1) of discriminating times.

8. An apparatus according to claim 7, wherein said correction processing unit corrects said corrected number (K·N1) of discriminating times to a value (A·K·N1) by further multiplying said (K·N1) by a predetermined delay coefficient (A) to delay the discrimination of the toner empty.

9. An apparatus in which an electrostatic latent image formed on a photosensitive material is developed and, thereafter, is transferred onto a paper, comprising:

a developing unit for developing the electrostatic latent image on said photosensitive material by a two-component developing agent composed of toner and carrier;

a toner density sensor for detecting a toner density of said two-component developing agent in said developing unit;

a toner hopper containing the toner to be supplied to said developing unit by receiving a filling of a specified amount of toner by the setting of a toner cartridge;

a toner supplying mechanism for supplying the toner from said toner hopper to said developing unit;

a toner supply control unit for supplying the toner from said toner hopper to said developing unit by driving said toner supplying mechanism each time a detection density of said toner density sensor is equal to or less than a specified value;

a toner sensor for detecting the toner contained in said toner hopper;

a toner empty discriminating unit for discriminating a toner empty on the basis of a detection value of said toner sensor;

a toner supply counter which is reset at the time of the filling of the toner by the setting of said toner cartridge and counts the number of toner supplying times by said toner supply control unit; and a toner supply amount calculating unit for calculating a toner supply amount per time from the number of toner supplying times of said toner supply counter and a specified toner filling amount by said toner cartridge when said toner empty is determined.

10. An apparatus according to claim 9, further comprising:

a correction processing unit for correcting control parameters of said toner supply control unit so as to maintain a predetermined specified toner supply amount w0 on the basis of a toner supply amount (w) calculated by said toner supply amount calculating unit.

11. An apparatus according to claim 10, wherein in said toner supply control unit, a rotational speed (R) and a supply operation time (T) of a toner supply roller to supply said specified toner supply amount w0 of toner have been preset as control parameters of said toner supplying mechanism, and said correction processing unit obtains a ratio (w0/w) between said specified toner supply amount w0 and said toner supply amount (w) calculated by said toner supply amount calculating unit as a correction coefficient (K) and corrects to a value (K·R) by multiplying said roller rotational speed (R) by said correction coefficient (K).

12. An apparatus according to claim 10, wherein in said toner supply control unit, a rotational speed (R) and a supply operation time (T) of a toner supply roller to supply said specified toner supply amount w0 have been preset as control parameters of said toner supplying mechanism, and said correction processing unit obtains a ratio (w0/w) between said specified toner supply amount w0 and said toner supply amount (w) calculated by said toner supply amount calculating unit as a correction coefficient (K) and corrects to a value (T·R) by multiplying said supply operation time (T) by said correction coefficient (K).

13. An apparatus according to claim 10, further comprising:

a life counter of an expendable item which is reset at the time of replacement of the expendable item and counts the number of toner supplying times by said toner supply control unit; and an expendable item replacement discriminating unit for discriminating a replacement of the expendable item when the number of toner supplying times counted by said life counter reaches a predetermined number N2 of discriminating times of the expendable item replacement, and wherein said correction processing unit obtains a ratio (w0/w) between said specified toner supply amount w0 and said toner supply amount (w) calculated by said toner supply amount calculating unit as a correction coefficient (K) and multiplies said number N2 of replacement discriminating times by said correction coefficient (K), thereby correcting to a correction number (K·N2) of discriminating times.

14. An apparatus according to claim 13, wherein said expendable item replacement discriminating unit discriminates the replacement of expendable items, said expendable items being at least a cleaning blade, cleaning brush, desmoke filter of a flash fixing unit, and toner collecting filter of a cleaning blower.

* * * * *